US012571207B2

(12) United States Patent
Smucker

(10) Patent No.: US 12,571,207 B2
(45) Date of Patent: Mar. 10, 2026

(54) LOGGING NOTCH ASSEMBLY

(71) Applicant: Lancaster Log Cabins, Gap, PA (US)

(72) Inventor: Dan Smucker, Gap, PA (US)

(73) Assignee: Lancaster Log Cabins, Gap, PA (US)

( * ) Notice: Subject to any disclaimer, the term of this patent is extended or adjusted under 35 U.S.C. 154(b) by 142 days.

(21) Appl. No.: 18/125,869

(22) Filed: Mar. 24, 2023

(65) Prior Publication Data

US 2024/0318422 A1 Sep. 26, 2024

(51) Int. Cl.
*E04B 2/70* (2006.01)

(52) U.S. Cl.
CPC ..... *E04B 2/702* (2013.01)

(58) Field of Classification Search
CPC ..... E04B 2/702; E04B 2/704; E04B 2/705
USPC ..... 52/233
See application file for complete search history.

(56) References Cited

U.S. PATENT DOCUMENTS 2,059,598 A * 11/1936 Paulson ..... A63H 33/04 446/85
2,712,678 A * 7/1955 Jensen ..... E04B 2/702 403/384
3,257,762 A * 6/1966 Steiner ..... E04B 2/702 446/106
3,552,079 A * 1/1971 Mortensen ..... E04B 2/702 52/309.8
4,219,977 A * 9/1980 Bene ..... E04B 2/702 52/73
4,287,694 A * 9/1981 Cornell ..... E04B 2/702 52/394
4,903,447 A * 2/1990 McDade ..... E04B 2/702 52/592.5
6,094,876 A * 8/2000 Ogo ..... E04B 2/702 52/272
6,146,232 A 11/2000 Robbins
2002/0124524 A1* 9/2002 Lokken ..... E04B 2/02 52/233

FOREIGN PATENT DOCUMENTS

DE 29702662 U1 * 4/1997 ..... E04B 2/702
DE 202014005070 U1 * 9/2014 ..... E04B 2/702

* cited by examiner

*Primary Examiner* — Christine T Cajilig
(74) *Attorney, Agent, or Firm* — Barley Snyder

(57) ABSTRACT

A logging notch assembly having a head member and a body member. The head member includes a head front face, a tapered upper face diagonally positioned downwards towards the head front face, a top face with a head connector member protruding from a central region of the top face, and a tapered lower face diagonally positioned upwards towards the head front face. The bottom face incudes a head channel positioned through a central region of the bottom face and receives the head connector member, a pair of side faces with an upper surface positioned between the top face and a side face of the pair of side faces, a lower surface positioned between the side face and the bottom face, an end surface positioned between the upper surface and the lower surface.

20 Claims, 11 Drawing Sheets

LOGGING NOTCH ASSEMBLY

FIELD OF THE INVENTION

The present invention relates to a logging notch assembly and, more particularly, to a logging notch assembly for stacking and preventing seepage of moisture during foul weather.

BACKGROUND

In general, references related to building log units, adapted to be easily assembled are presently disclosed to the public. Some of the references relating to these log units, include grooves within the log to provide easy stacking of multiple logs. However, the previous designs also have vulnerabilities and flaws. One key vulnerability is the susceptibleness to foul weather including rain. Previous designs lack the structural properties for providing adequate coverage between each individual log to prevent seepage and rot within the log and the interior of the raised log structure which therefore jeopardizes the longevity of each log and the stability of the overall structure.

It is desirable to provide a logging notch assembly that provides the proper protection against seepage within each induvial log and the interior of the raised log structure.

As the foregoing illustrates, the invention provides a logging notch assembly for prevention of seepage within each assembly and the overall raised structure.

SUMMARY

A logging notch assembly having a head member and a body member. The head member includes a head front face, a tapered upper face diagonally positioned downwards towards the head front face, a top face with a head connector member protruding from a central region of the top face, and a tapered lower face diagonally positioned upwards towards the head front face. The bottom face incudes a head channel positioned through a central region of the bottom face and receives the head connector member, a pair of side faces with an upper surface positioned between the top face and a side face of the pair of side faces, a lower surface positioned between the side face and the bottom face, an end surface positioned between the upper surface and the lower surface.

BRIEF DESCRIPTION OF DRAWINGS

In the following, the present invention is described in more detail with references to the drawings in which.

DETAILED DESCRIPTION OF THE EMBODIMENTS

Figure 1:
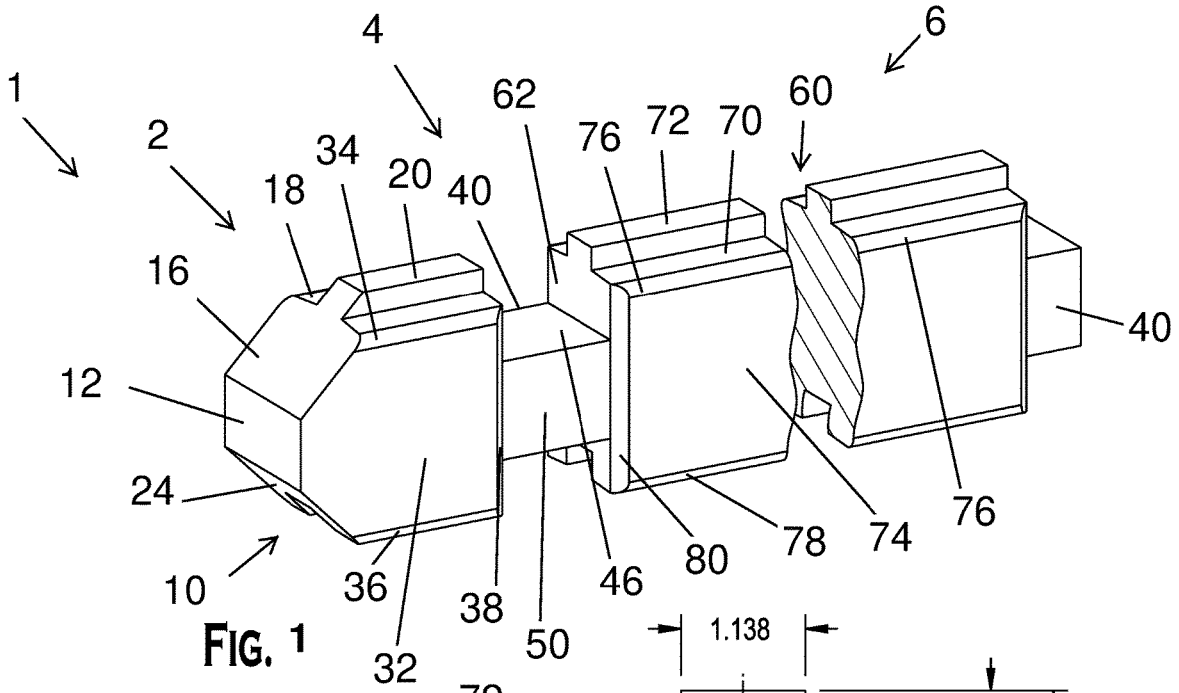
FIG. 1 illustrates a top, front, left side perspective view.
Figure 2:
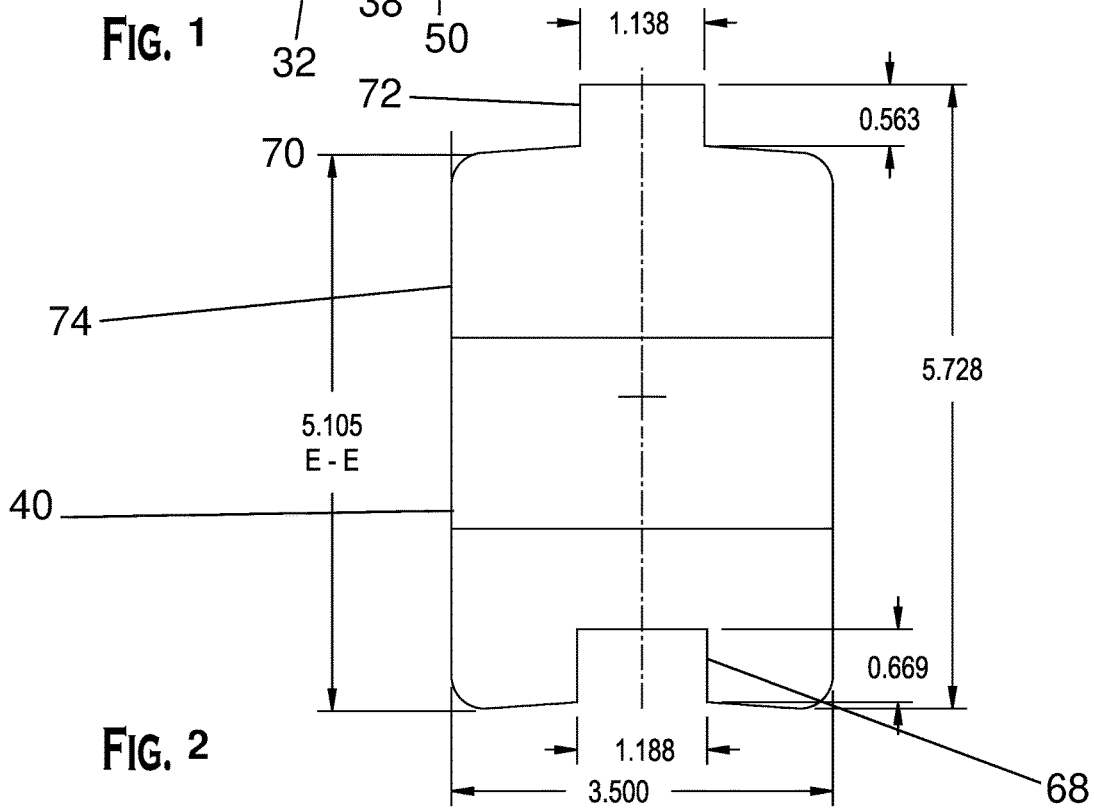
FIG. 2 illustrates a rear perspective view of FIG. 1.
Figure 3:
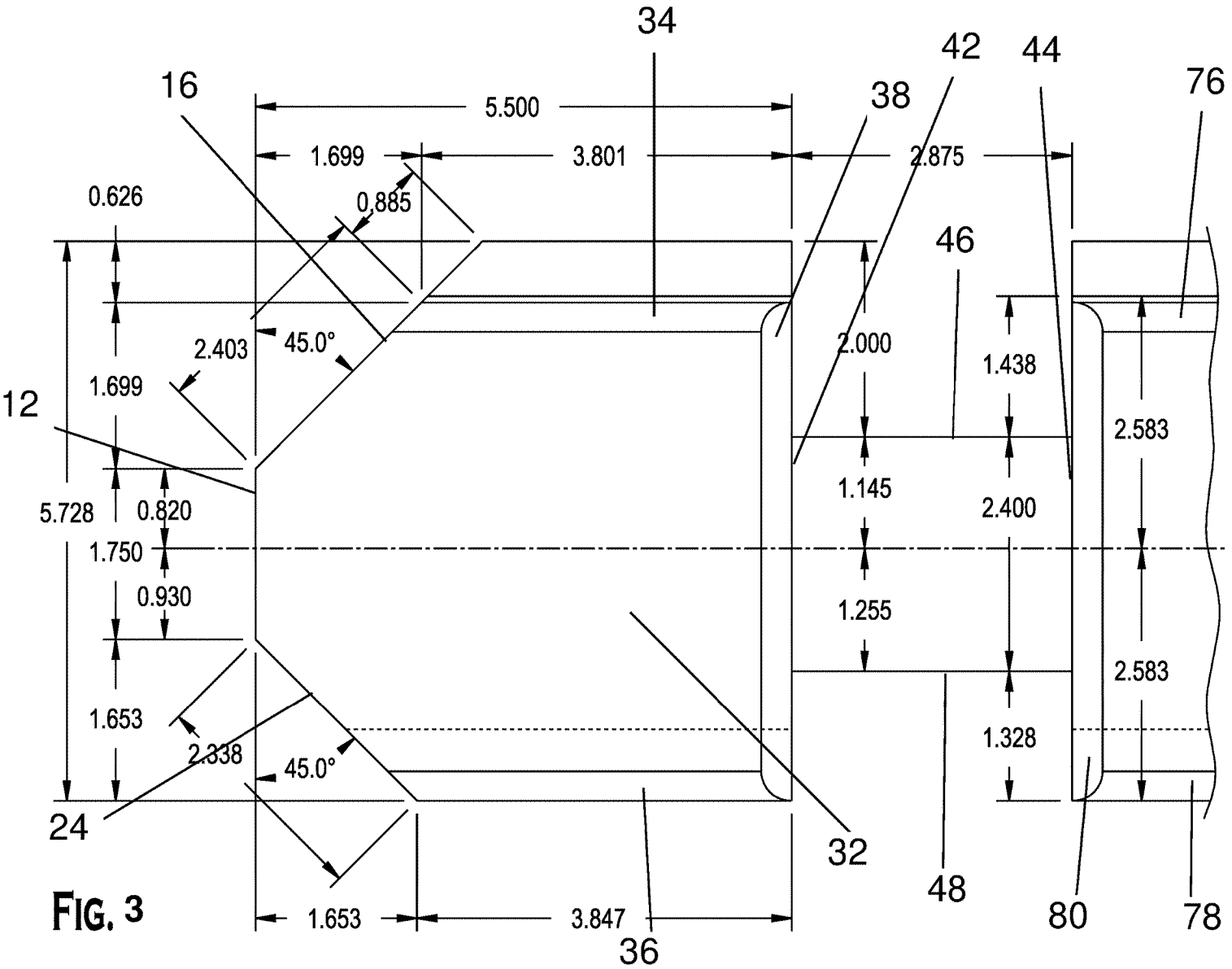
FIG. 3 illustrates a left side perspective view of FIG. 2.
Figure 4:
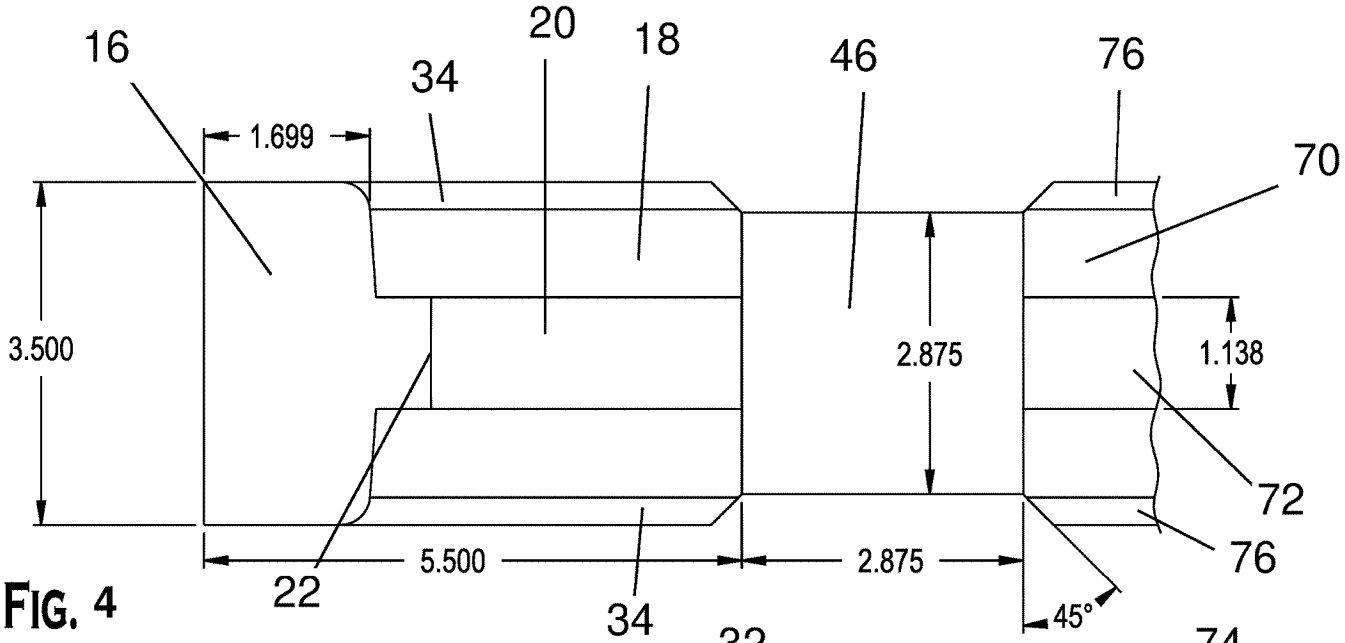
FIG. 4 illustrates a top perspective view of FIG. 3.
Figure 5:
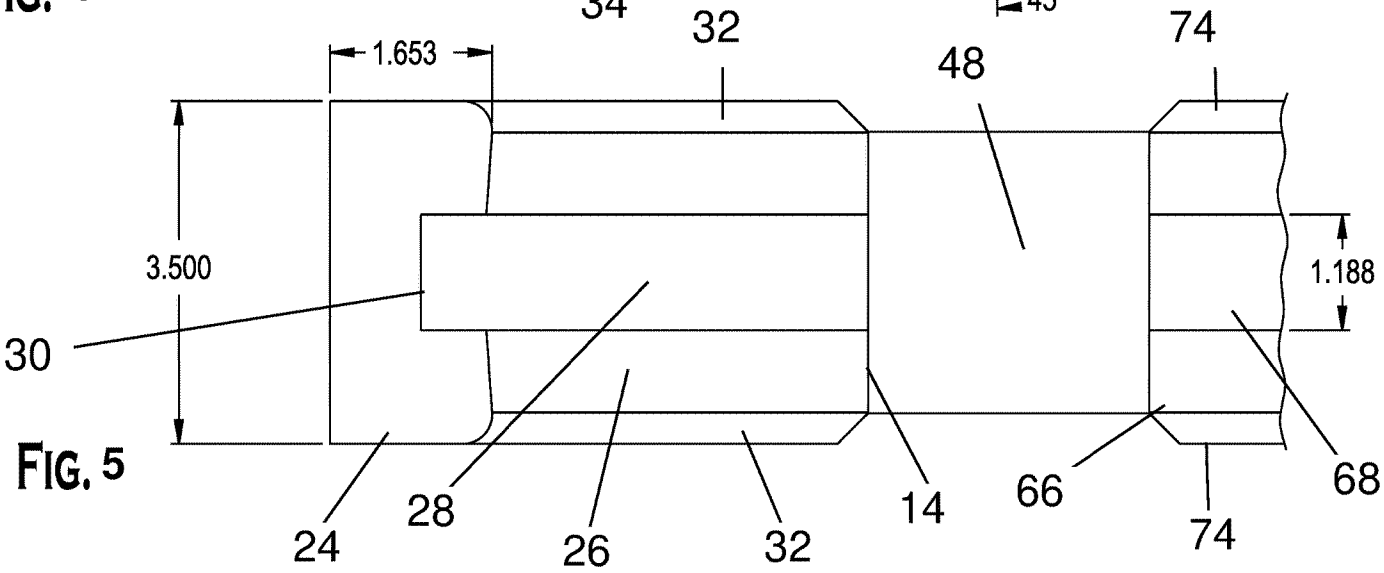
FIG. 5 illustrates a bottom perspective view of FIG. 4.
Figure 6:
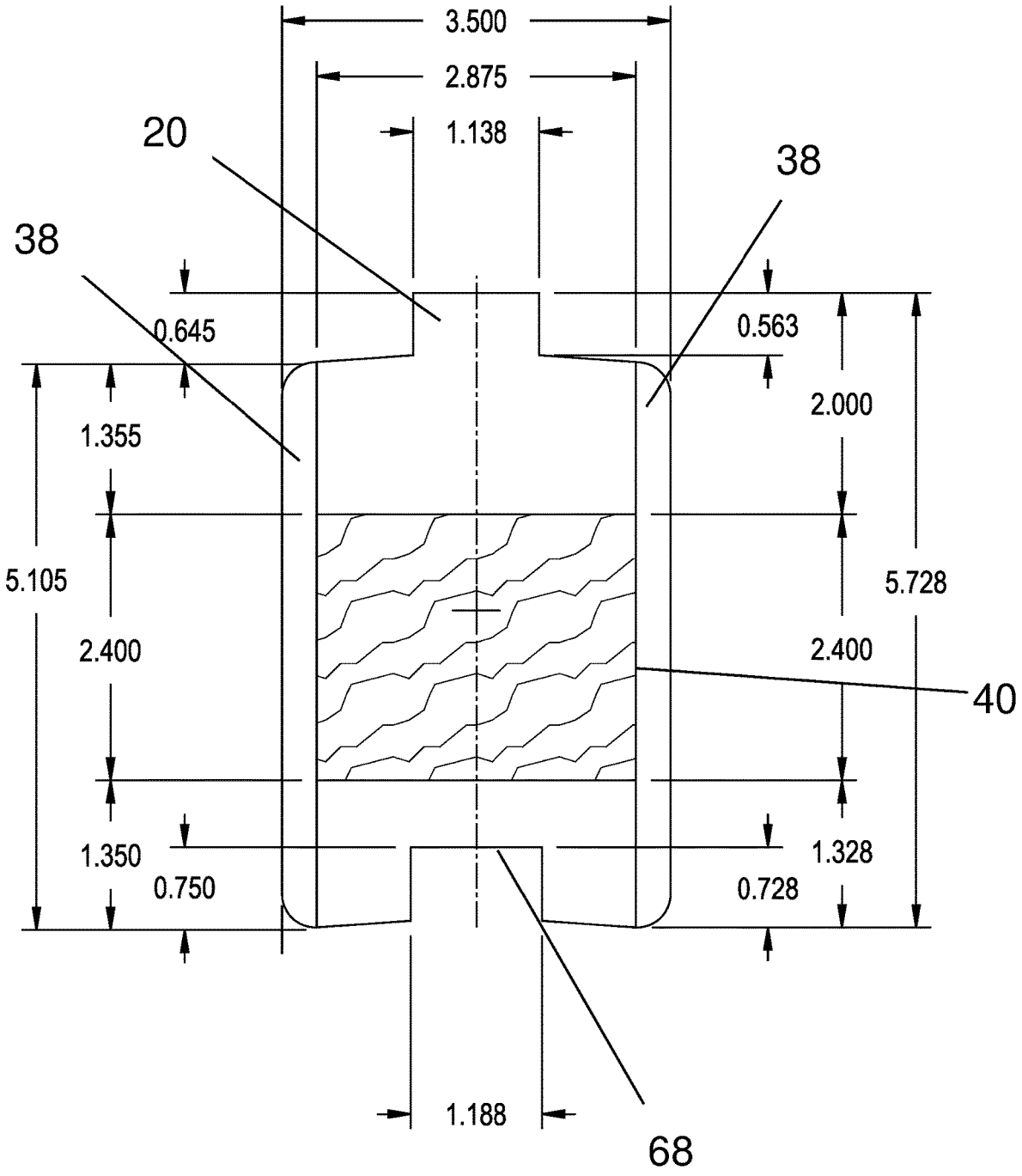
FIG. 6 illustrates a rear perspective view of FIG. 5.
Figure 7:
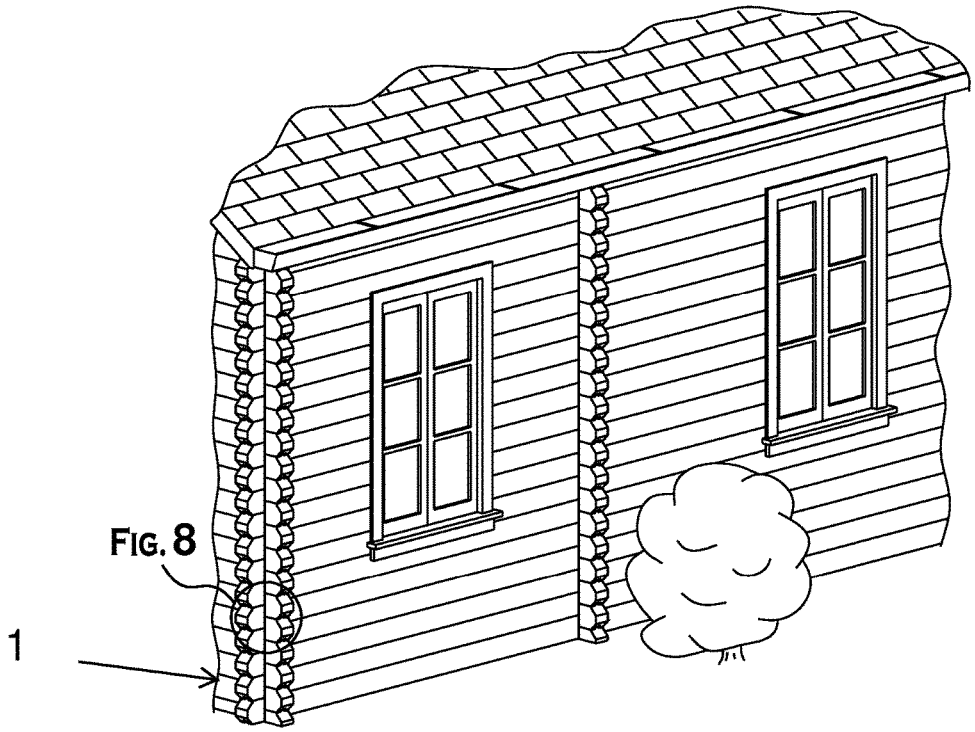
FIG. 7 illustrates a perspective view of FIG. 6.

The present disclosure includes a logging notch assembly 1. The logging notch assembly 1 generally includes a head assembly 2, a neck assembly 4 and a body assembly 6 as illustrated through FIGS. 1-15.

The head assembly 2 generally includes a head member 10. The head member 10 is hexagonal shaped. The head member 10 includes a plurality of faces.

The head member 10 includes a head front face 12. The head front face 12 is rectangular and perpendicular to a level ground surface.

The head member 10 further includes a rear face 14 opposite the head front face 12. The rear face 14 is polygonal shaped. One skilled in the art would understand the applicant's design is not the exclusive embodiment.

The head member 10 further includes a tapered upper face 16. The tapered upper face 16 is adjacent the head front face 12. The tapered upper face 16 is diagonally positioned downwards towards the head front face 12.

The head member further includes a top face 18. The top face 18 is rectangular. The top face 18 further includes a head connector member 20. The head connector member 20 is a rectangular block protruding from a central region of the top face 18. A portion of the head connector 22 links and joins the tapered upper face 16 as illustrated. The head connector member 20 furthermore extends from the tapered upper face 16 along the top face 18 and ends at the rear face 14.

The head member 10 further includes a tapered lower face 24. The tapered lower face 24 is adjacent the head front face 12. The tapered lower face 24 is diagonally positioned upwards towards the head front face 12. The tapered lower face 24 is configured in a u-shape formation.

The head member 10 further includes a bottom face 26. The bottom face 26 is rectangular shaped. The bottom face 26 further includes a head channel 28 positioned through a central region of the bottom face 26. A portion of the head channel 30 links and joins the tapered lower face 24.

The head member 10 further includes a pair of side faces 32. Each side face 32 is hexagonal shaped. Each side face 32 further includes an upper surface 34, a lower surface 36 opposite the upper surface 34, and an end surface 38. The upper surface 34 is tapered, positioned between the top face 18 and the side face 32 of the head member 10. Each upper surface 34 is a filleted end of each side face 32 of the pair of side faces 32.

The upper surface 34 further extends along the top face 18, beginning at the tapered upper face 16 and ending at the rear face 14. One skilled in the art would understand the applicant's design is not the exclusive embodiment.

The lower surface 36 is tapered, positioned between the side face 32 and the bottom face 26 of the head member 10. The lower surface 36 includes a smaller surface area than a surface area of the upper surface 34. The lower surface 36 further extends along the bottom face 26, beginning at the tapered lower face 24 and ending at the rear face 14. Each lower surface 36 is a filleted end of each side face 32 of the pair of side faces 32.

The end surface 38 is tapered, positioned between the upper surface 34 and the lower surface 36. The end surface 38 extends along the length of the rear face 14 of the head member 10, beginning at the top face 18 and ending at the bottom face 26.

As illustrated, the neck assembly 4 generally includes a neck member 40. The neck member 40 is a block configuration. The neck member 40 includes a plurality of panels.

As illustrated, the neck member includes a front panel 42. The front panel 42 is square shaped.

The neck member 40 further includes a rear panel 44 opposite the front panel 42. The rear panel 44 is square shaped.

The neck member 40 further includes a top panel 46. The top panel 46 is square shaped. One skilled in the art would understand the applicant's design is not the exclusive embodiment.

The neck member 40 further includes a bottom panel 48 opposite the top panel 46. The bottom panel 48 is square shaped.

The neck member 40 further includes a pair of side panels 50 positioned on opposing sides. Each of the side panels 50 are square shaped. One skilled in the art would understand the applicant's design is not the exclusive embodiment.

As illustrated, the body assembly 6 generally includes a body member 60. The body member 60 is polygon shaped. The body member 60 further includes a plurality of faces.

As shown, the body member 60 includes a body front face 62. The body front face 62 is polygon shaped.

The body member 60 further includes a rear face 64. The rear face 64 is a mirror image of the body front face 62. One skilled in the art would understand the applicant's design is not the exclusive embodiment.

The body member 60 further includes a bottom face 66. The bottom face 66 is rectangular shaped. The bottom face 66 further includes a body channel 68. The body channel 68 is a u-shaped configuration extending along the length of a central region of the bottom face 66. The body channel 68 begins at the body front face 62 and extends along the bottom face 66 until the body channel 68 reaches the rear face 64 of the body member 60. Additionally, the body channel 68 and the head channel 28 extend along the same longitudinal axis.

The body member 60 further includes a top face 70. The top face 70 is rectangular shaped. The top face 70 further includes a body connector member 72. The body connector member 72 is a rectangular block protruding from the top face 70. The body connector member 72 begins at the body front face 62 and extends along the top face 70 until the body connector member 72 reaches the rear face 64. The body connector member 72 and the head connector member 20 extend along the same longitudinal axis.

The body member 60 further includes a pair of side faces 74. Each side face 74 is rectangular shaped. Each side face 74 further includes an upper surface 76, a lower surface 78 opposite the upper surface 76, and an end surface 80.

The upper surface 76 is tapered, positioned between the top face 70 and the side face 74 of the body member 60. The upper surface 76 further extends along the top face 70, beginning at the body front face 62 and ending at the rear face 64. Each upper surface 76 is a filleted end of each side face 74 of the pair of side faces 74. One skilled in the art would understand the applicant's design is not the exclusive embodiment.

The lower surface 78 is tapered, positioned between the side face 74 and the bottom face 66 of the body member 60. The lower surface 78 includes a smaller surface area than a surface area of the upper surface 76. The lower surface 78 further extends along the bottom face 66, beginning at the body front face 62 and ending at the rear face 64. Each lower surface 78 is a filleted end of each side face 74 of the pair of side faces 74.

The end surface 80 is tapered, positioned between the upper surface 76 and the lower surface 78. The end surface 80 extends along the length of the body front face 62. Additionally, the end surface 80 extends along the length of the rear face 64.

As assembled, the neck member 40 is positioned between the head member 10 and the body member 60. Specifically, the front panel 42 of the neck member 40 is positioned against rear face 14 of the head member 10. Additionally, the rear panel 44 is positioned against the body front face 62 as illustrated. In another embodiment, an additional neck member 40 is positioned to the rear face 64 of the body member 60 for a longer dimensional logging notch assembly.

A logging assembly comprising a plurality of logging notch assemblies is now described. The reference numeral of the logging notch assemblies below are relative; thus, a first logging notch assembly 100, a second logging notch assembly 200, and a third logging notch assembly 300 can all be interchanged as the logging notch assemblies 100,200,300 all include the same elements as the first logging notch assembly 100 as described above. The logging assembly may further comprise multiple logging notch assemblies 100,200,300 or as many additional other logging notch assemblies as necessary to reach a desired height of the logging assembly.

Generally, as illustrated in FIGS. 9-15, a user positions a first logging notch assembly 100 on the level ground surface. The user then positions a second logging notch assembly 200 at an intersecting point with respect to the first logging notch assembly 100.

The bottom panel 48 of the neck member 40 of the second logging notch assembly 200 rests on the top panel 46 of the neck member 40 of the first logging notch assembly 100. Simultaneously, the end surface 80 of the second logging notch assembly 200 is flush with the end surface 80 of the first logging notch assembly 100. Furthermore, to provide additional height, the user can continue adding additional logging notch assemblies.

Figure 13:
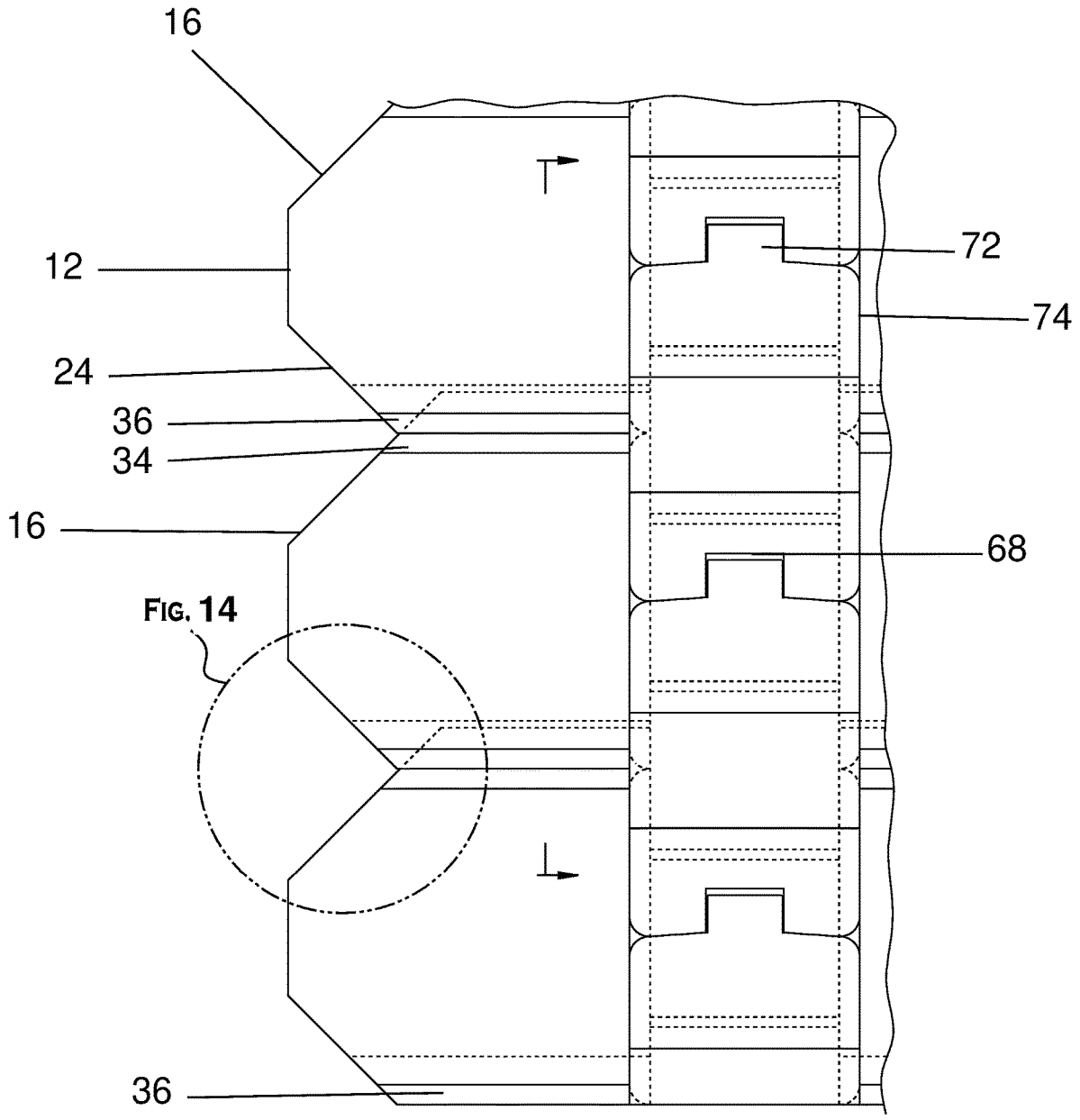
FIG. 13 is another cross view of FIG. 12.
Figure 14:
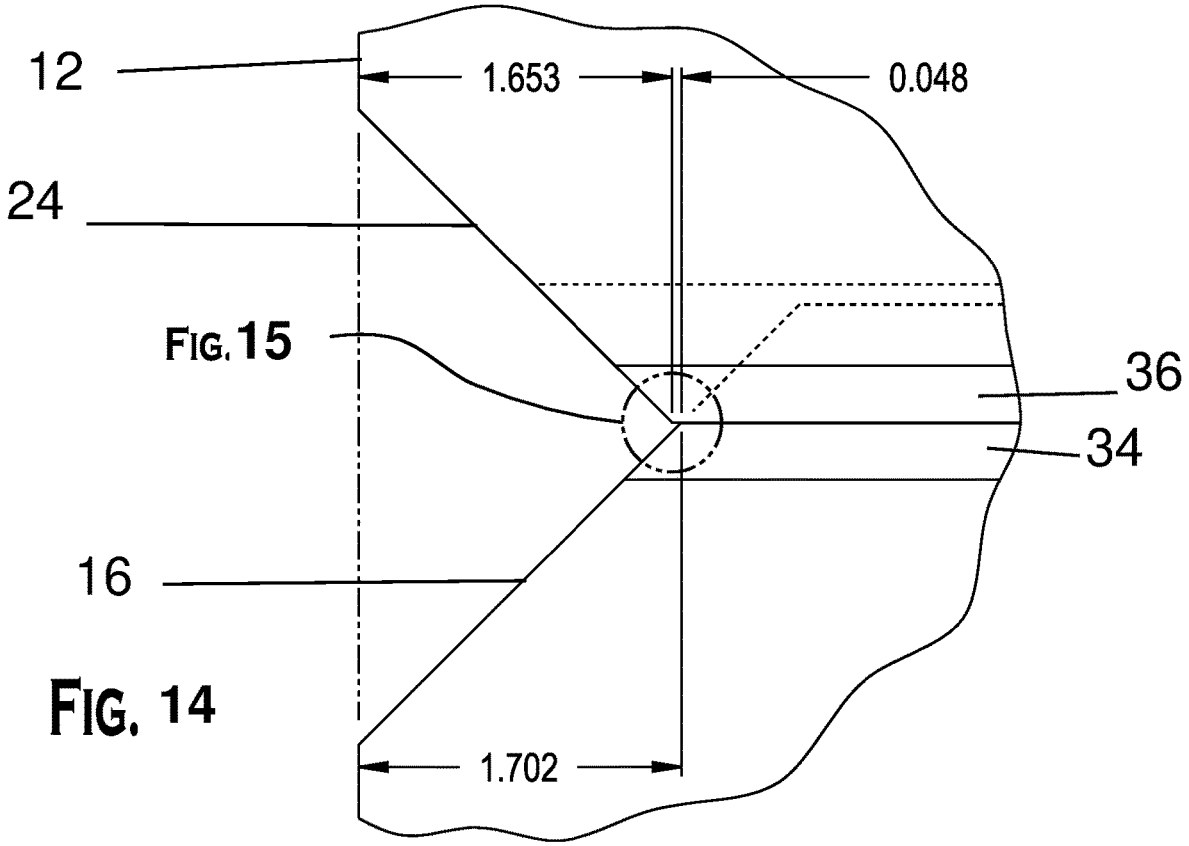
FIG. 14 is an enlarged view of FIG. 13.
Figure 15:
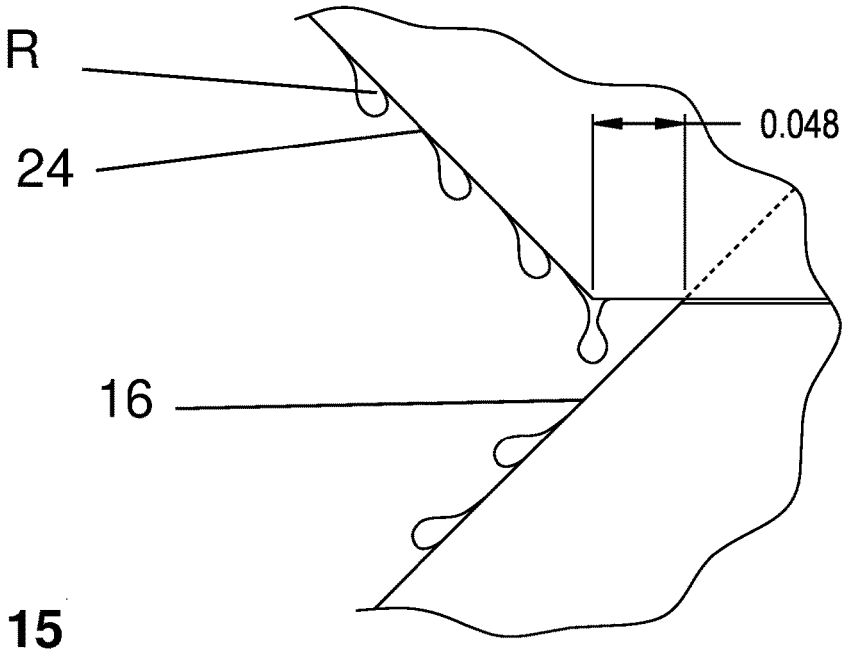
FIG. 15 is another enlarged view of FIG. 14.

As illustrated, a third logging notch assembly 300 is positioned on the top panel 46 of the neck member 40 of the second logging notch assembly 200. In a synchronous fashion, the head connector member 20 of the first logging notch assembly 100 is received within the head channel 28 of the third logging notch assembly 300. The lower surface 36 of the third logging notch assembly 300 hangs over the upper surface 34 of the first logging notch assembly 100 forming a first overhang as illustrated in FIGS. 13-15. The lower surface 36 of the pair of side faces 32 of the head member 10 of the third logging notch assembly 300 and the upper surface 34 of the pair of side faces 32 of the head member 10 of the first logging notch assembly 100 are nonparallel.

As shown in FIGS. 13-15, a second overhang is formed by the bottom face 26 of the head member 10 of the third logging notch assembly 300 hanging over the tapered upper face 16 of the first logging notch assembly 100. The bottom face 26 of the head member 10 of the third logging notch assembly 300 and the tapered lower face of the first logging notch assembly 100 are nonparallel.

Figure 8:
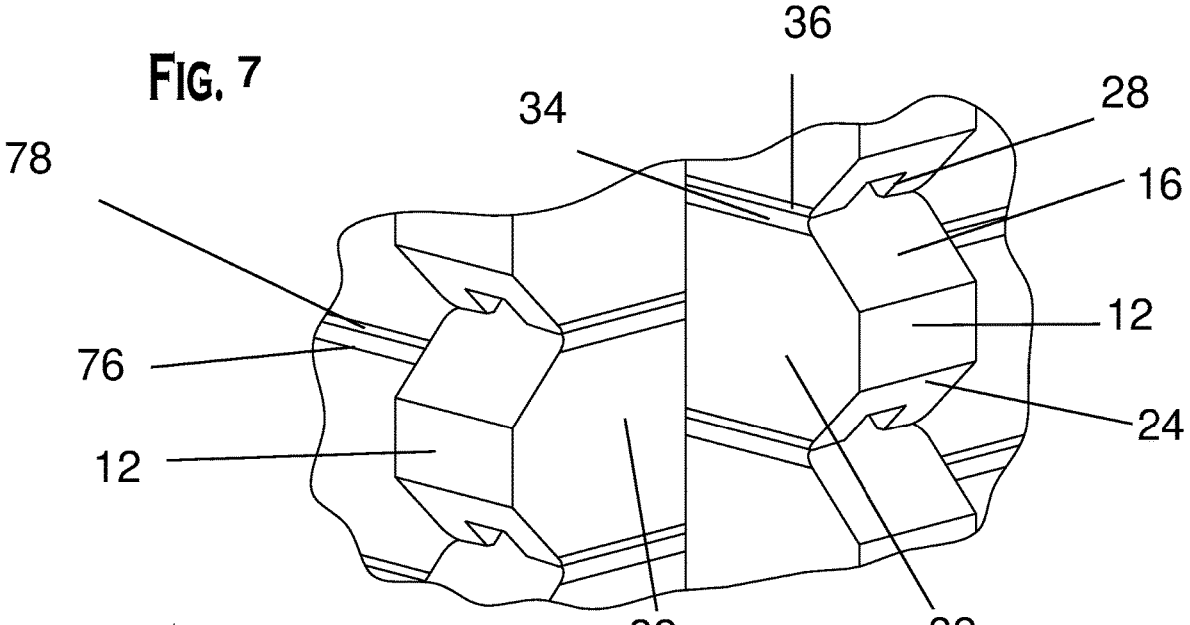
FIG. 8 illustrates an enlarged perspective view of FIG. 7.
Figure 9:
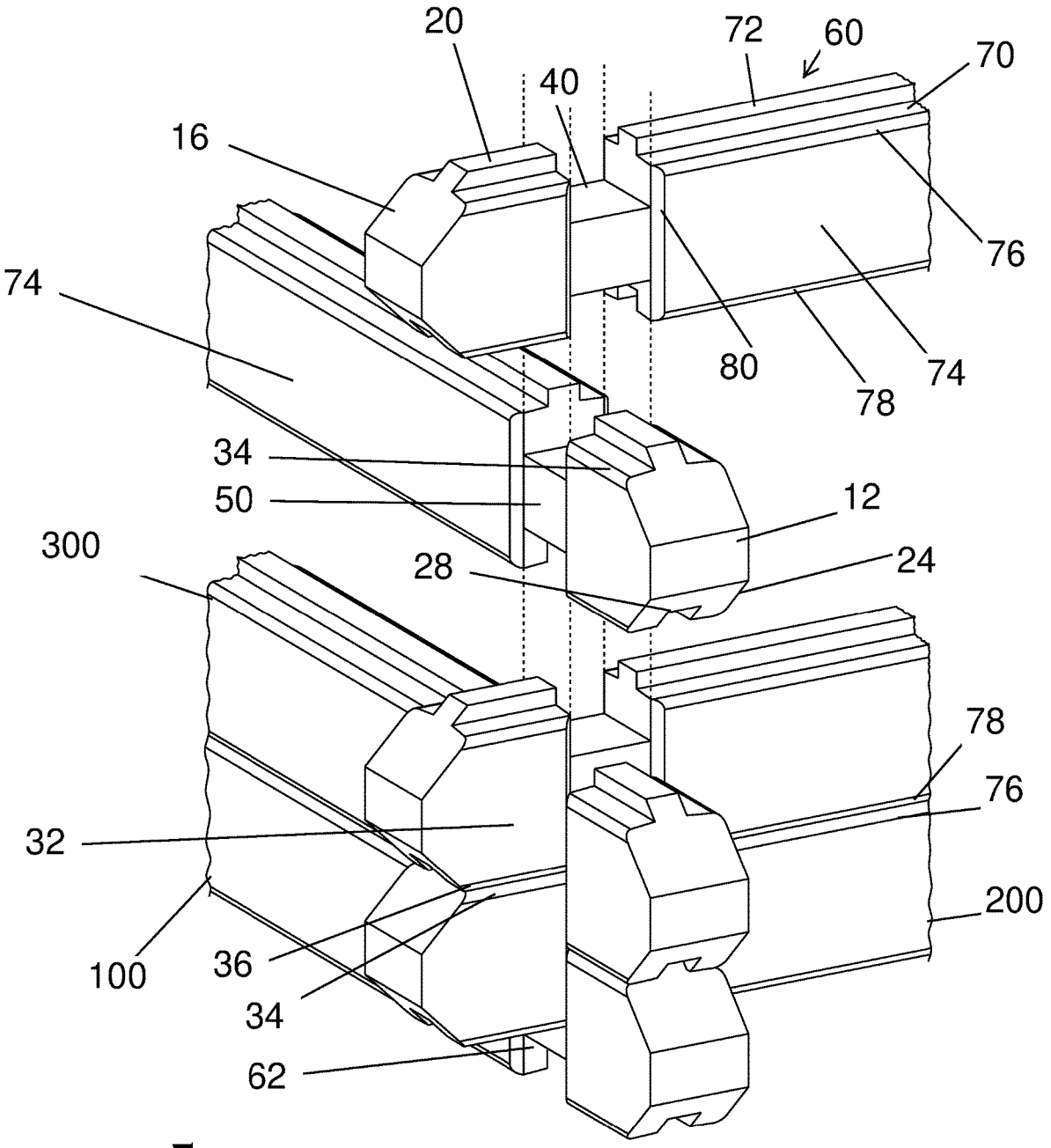
FIG. 9 illustrates a plurality of logging notch assemblies of FIG. 8.
Figure 10:
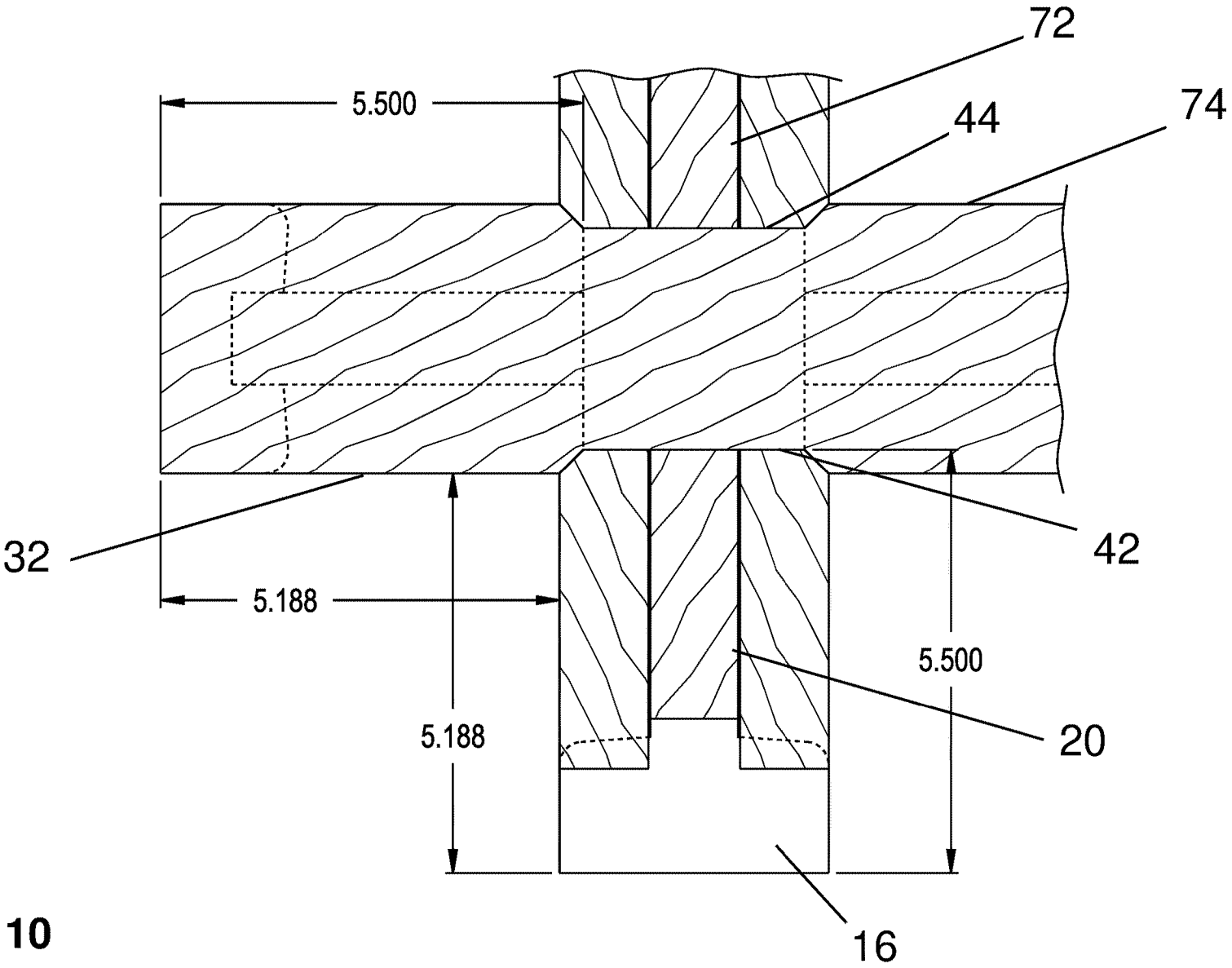
FIG. 10 illustrates a top view of FIG. 9.
Figure 11:
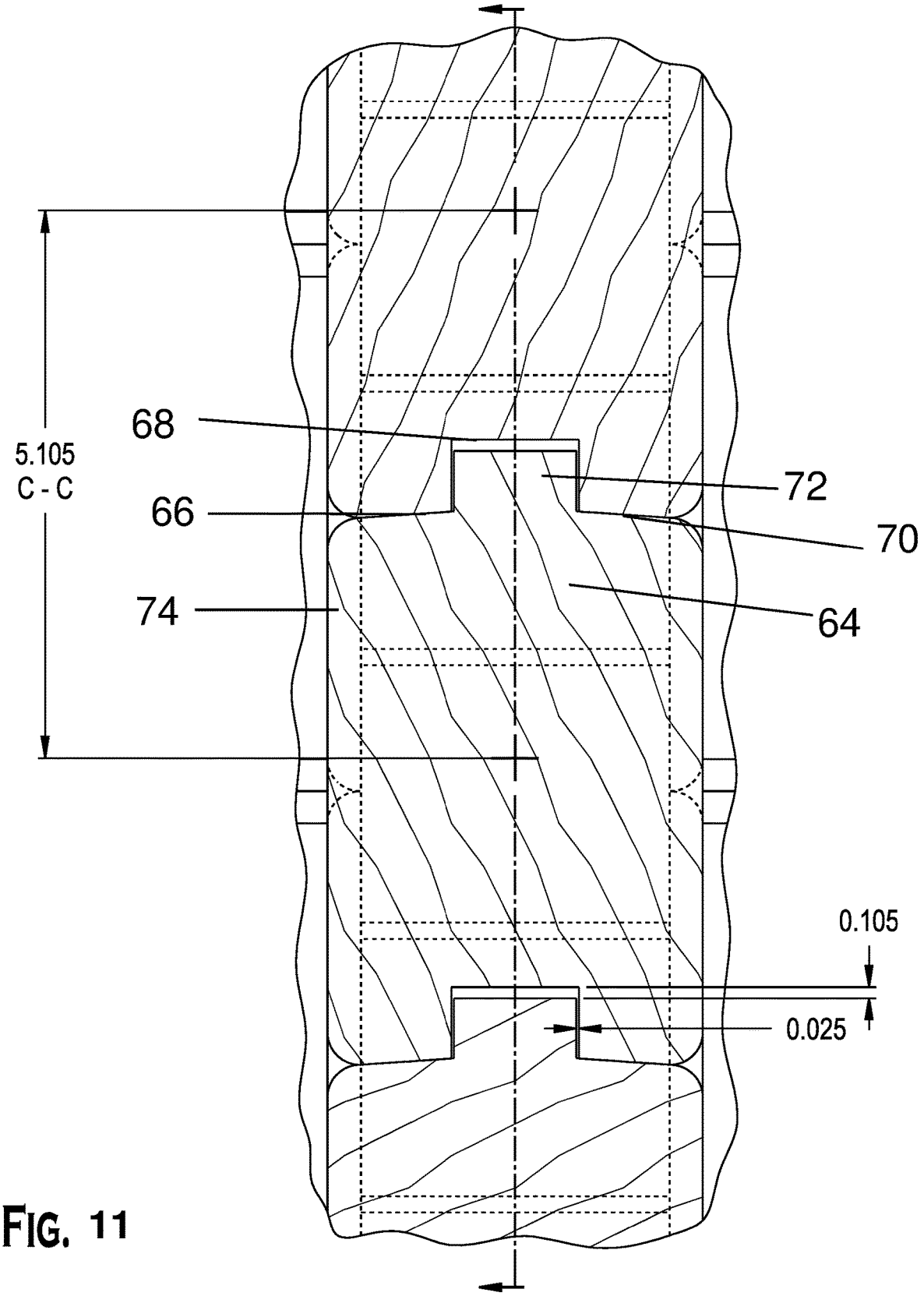
FIG. 11 illustrates a rear view of FIG. 10.
Figure 12:
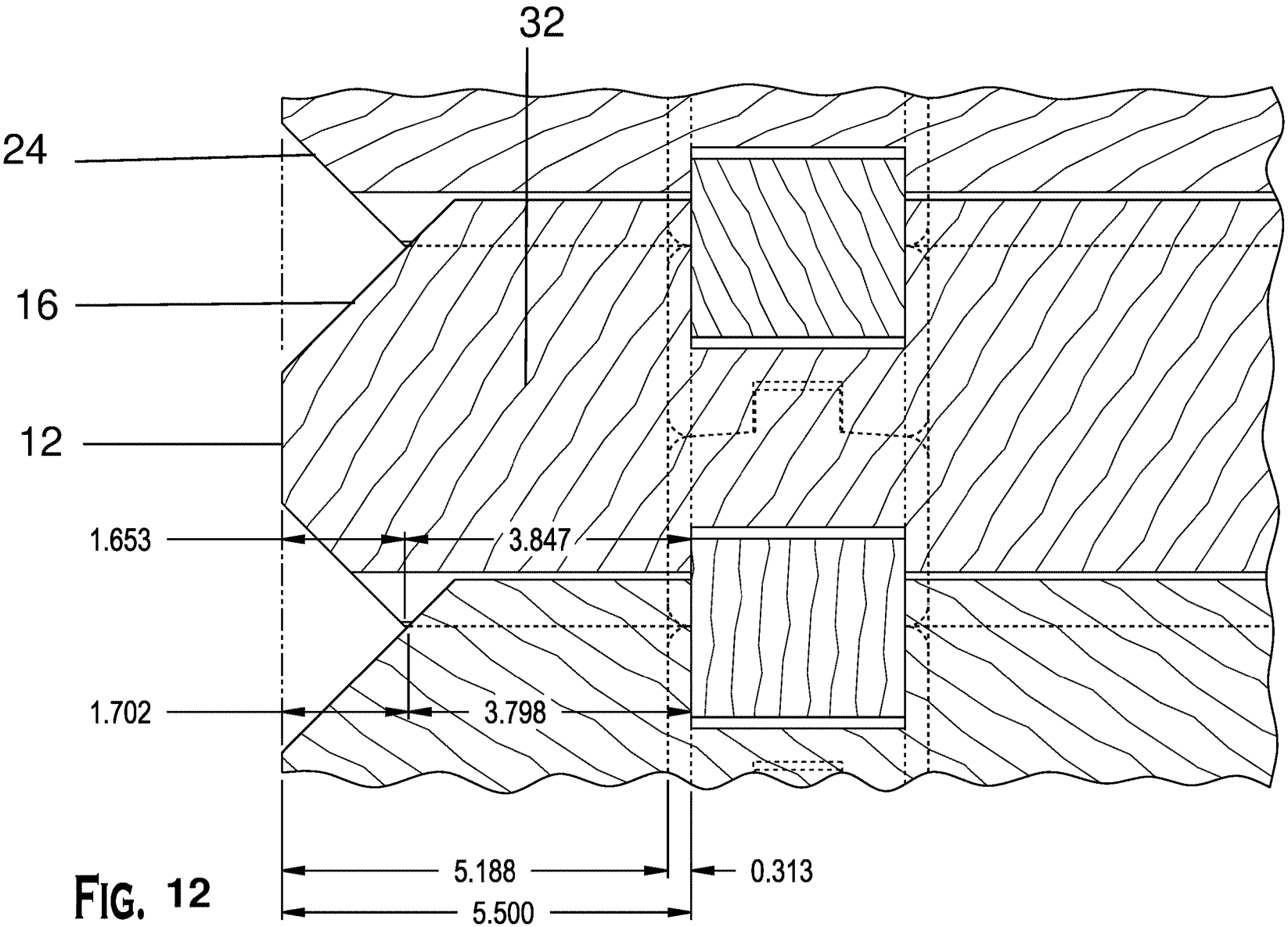
FIG. 12 illustrates a cross section view of FIG. 11.

Additionally, the body connector member 72 of the first logging notch assembly 100 is received within the body channel 68 of the third logging notch assembly 300. Consequently, the lower surface 78 of the third logging notch assembly 300 hangs over the upper surface 76 of the first logging notch assembly 100 forming a third overhang as illustrated in FIGS. 8-9. The lower surface 78 of the pair of side faces 74 of the body member 60 of the third logging notch assembly 300 and the upper surface 76 of the pair of side faces 74 of the body member 60 of the first logging notch assembly 100 are nonparallel. The lower surface 78 of the third logging notch assembly 300 becomes adjacent to the upper surface 76 of the first logging notch assembly 100. The user will continue to stack, logging notch assemblies until the desired height is reached.

It is inevitable that the stacked logging notch assemblies will be exposed to foul weather, including rain R. When the rain R encounters the side face 32 of the logging notch assemblies, the overhang formed by the lower surface 36 and the upper surface 34 permits the rain to flow down the lower surface 36 and drain to the ground protecting the adjacent logging notch assembly from receiving run off and seepage between the logging notch assemblies.

When the rain encounters the side face 74 of the logging notch assemblies, the overhang formed by the lower surface 78 and the upper surface 76 permits the rain to flow down the lower surface 78 and drain to the ground protecting the adjacent logging notch assembly from receiving run off and seepage between the logging notch assemblies.

When the rain encounters the head front face 12 of the head member 10, the rain will flow from the head front face 12 of the third logging notch assembly 300 to the tapered lower face 24. The rain will continue to flow down to the tapered upper face 16 of the adjacent logging notch assembly and drain to the ground preventing seepage between the logging notch assemblies.

It should be noted that various changes and modifications to the embodiments described herein will be apparent to those skilled in the art. Such changes and modifications may be made without departing from the spirit and scope of the present invention and without diminishing its intended advantages. For example, various embodiments may be provided based on various combinations of the features and functions from the subject matter provided herein.

What is claimed is:

1. A logging assembly comprising:

a first logging notch assembly and a third logging notch assembly, each of the logging notch assemblies including:

a head member having:

a head front face;

a tapered upper face diagonally positioned downwards towards the head front face;

a top face having:

a head connector member protruding from a central region of the top face;

a tapered lower face diagonally positioned upwards towards the head front face;

a bottom face having:

a head channel positioned through a central region of the bottom face and receives a head connector member of an adjacent logging notch assembly;

a pair of side faces having:

an upper surface positioned between the top face and a side face of the pair of side faces;

a lower surface positioned between the side face and the bottom face;

an end surface positioned between the upper surface and the lower surface;

a body member having:

a bottom face having:

a body channel extending along a length of a central region of the bottom face;

a top face having:

a body connector member protruding from the top face and received within a body channel of an adjacent logging notch assembly;

a pair of side faces having:

an upper surface;

a lower surface; and an end surface, a first overhang is formed by the lower surface of one side face of the head member of the third logging notch assembly hanging over the upper surface of one side face of the head member of the first logging notch assembly, the first overhang exposes a bottom face of the third logging notch assembly from contact with a top face of the first logging notch assembly forming a dry zone between the bottom face of the third logging notch assembly and the top face of the first logging notch assembly, the dry zone extends from a distance of the exposed bottom face and an equal distance of the top face, the lower surface of the one side face of the head member of the third logging notch assembly and the upper surface of the one side face of the head member of the first logging notch assembly are nonparallel.

2. The logging assembly of claim 1, wherein a second overhang is formed by the bottom face of the head member of the third logging notch assembly hanging over the tapered upper face of the first logging notch assembly, the bottom face of the head member of the third logging notch assembly and the tapered lower face of the first logging notch assembly are nonparallel.

3. The logging assembly of claim 1, wherein each upper surface and each lower surface of the pair of side faces of the head member of each logging notch assembly are filleted ends of the pair of side faces of the head member.

4. The logging assembly of claim 2, wherein a third overhang is formed by the lower surface of one side face of the body member of the third logging notch assembly hanging over the upper surface of one side face of the body member of the first logging notch assembly, the lower surface of the one side face of the body member of the third logging notch assembly and the upper surface of the one side face of the body member of the first logging notch assembly are nonparallel.

5. The logging assembly of claim 4, wherein each upper surface and each lower surface of the pair of side faces of the body member of each logging notch assembly are filleted ends of the pair of side faces of the body member.

6. The logging assembly of claim 1, wherein the head member and the body member of each logging notch assembly further include a neck member positioned therebetween.

7. The logging assembly of claim 6, wherein the body channel and the head channel of each logging notch assembly extend along the same longitudinal axis.

8. The logging assembly of claim 7, wherein the head connector member and the body connector member of each logging notch assembly extend along the same longitudinal axis.

9. The logging assembly of claim 8, wherein a portion of the head connector member of each logging notch assembly links and joins a tapered upper face of the adjacent logging notch assembly.

10. The logging assembly of claim 9, wherein each logging notch assembly head connector member extends from the tapered upper face along the top face and ends at a rear face of the head member.

11. The logging assembly of claim 10, wherein a portion of the head channel of each logging notch assembly links and joins a tapered lower face of an adjacent logging notch assembly.

12. The logging assembly of claim 11, wherein the lower surface of the head member of each logging notch assembly includes a smaller surface area than a surface area of the upper surface of the head member.

13. The logging assembly of claim 12, wherein the lower surface of the pair of side faces of the head member of each logging notch assembly further extends along the bottom face of the head member, beginning at the tapered lower face of the head member and ending at the rear face of the head member.

14. The logging assembly of claim 13, wherein the end surface of the pair of side faces of the head member of each logging notch assembly extends along a length of the rear face of the head member, beginning at the top face of the head member and ending at the bottom face of the head member.

15. The logging assembly of claim 14, wherein the tapered lower face of each logging notch assembly is configured in a u-shape formation.

16. The logging assembly of claim 15, wherein the neck member of each logging notch assembly is a block configuration.

17. The logging assembly of claim 16, wherein the neck member of each logging notch assembly further includes a front panel, a rear panel opposite the front panel, a top panel, and a bottom panel opposite the top panel.

18. The logging assembly of claim 17, wherein the front panel of each logging notch assembly is positioned against the rear face of the head member.

19. The logging assembly of claim 18, wherein the rear panel of each logging notch assembly is positioned against a body front face of the body member.

20. The logging assembly of claim 19, wherein each logging notch assembly further includes an additional neck member positioned at a rear face of the body member.

* * * * *